United States Patent [19]

Buer

[11] Patent Number: 4,995,314

[45] Date of Patent: Feb. 26, 1991

[54] CAN FLATTENING MACHINE

[75] Inventor: Jeffrey J. Buer, Lakewood, Iowa

[73] Assignee: Midamerica Recycling Company, Des Moines, Iowa

[21] Appl. No.: 425,331

[22] Filed: Oct. 23, 1989

[51] Int. Cl.[5] ..... B30B 5/04

[52] U.S. Cl. ..... 100/152; 100/902; 241/200

[58] Field of Search ..... 100/902, 151–154; 241/99, 200

[56] References Cited

U.S. PATENT DOCUMENTS

| | | | |
|---|---|---|---|
| 969,720 | 9/1910 | Pickett | 100/152 X |
| 1,140,676 | 5/1915 | Gray | 100/151 |
| 2,959,364 | 11/1960 | Anderson et al. | 241/200 |
| 3,691,942 | 9/1972 | Wagley | 100/902 X |
| 3,857,335 | 12/1974 | Wagley | 100/153 X |
| 4,014,256 | 3/1977 | Davis, Jr. | 100/902 X |
| 4,059,050 | 11/1977 | Davis, Jr. | 100/902 X |
| 4,463,844 | 8/1984 | Huffman et al. | 100/902 X |

FOREIGN PATENT DOCUMENTS

| | | | |
|---|---|---|---|
| 59-50997 | 3/1984 | Japan | 100/902 |
| 62-199296 | 9/1987 | Japan | 100/902 |
| 22060 | 6/1908 | United Kingdom | 100/151 |

*Primary Examiner*—Harvey C. Hornsby
*Assistant Examiner*—Stephen F. Gerrity
*Attorney, Agent, or Firm*—Zarley McKee, Thomte, Voorhees & Sease

[57] ABSTRACT

The can flattening machine of the present invention comprises a first conveyor for carrying the cans to the upper end of a hopper located above a pair of belt assemblies. The belt assemblies are elongated and are positioned relative to one another so as to create a V-shaped notch therebetween. The cans fall between the belt assemblies and are flattened between the lower ends of the belt assemblies. One of the lower ends of the belt assemblies is spring mounted with respect to the other so as to be yieldably movable away from the other belt assembly.

6 Claims, 1 Drawing Sheet

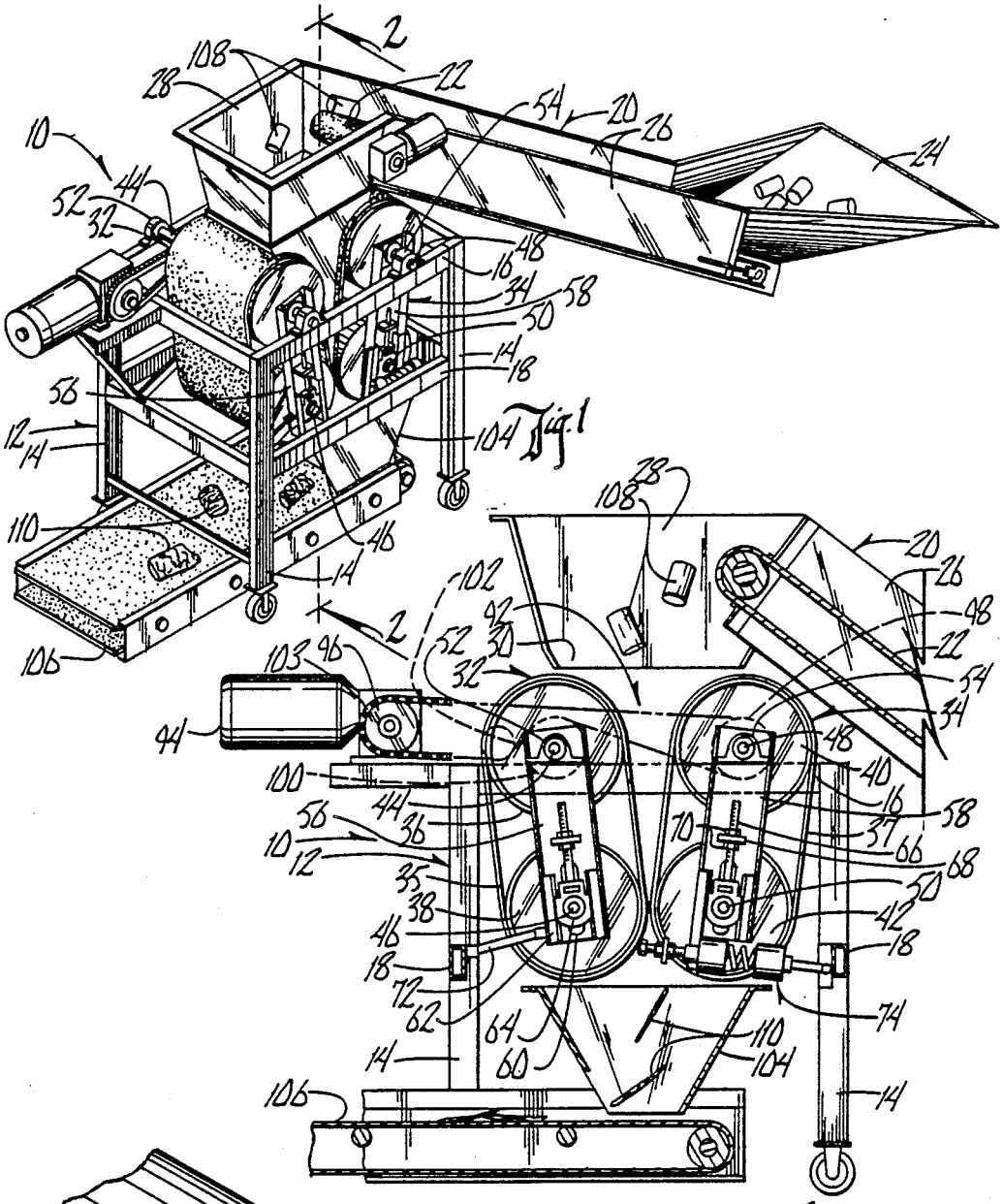
Fig. 1
Fig. 2
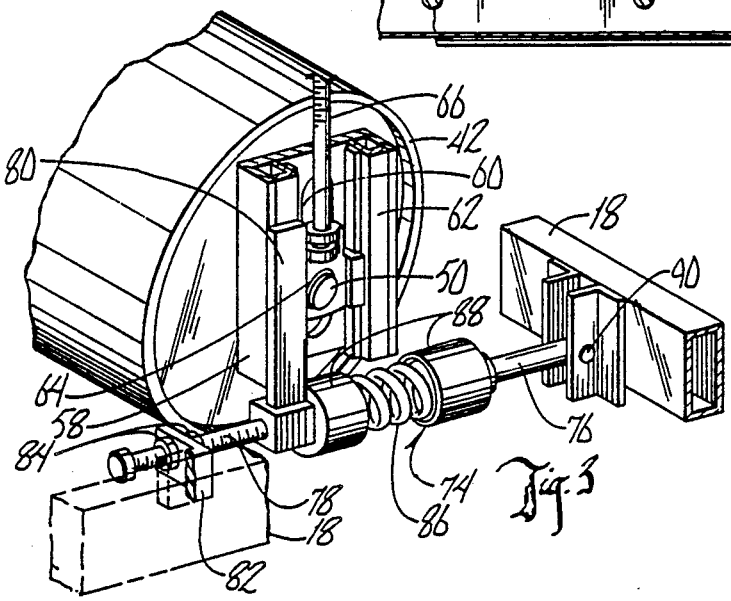
Fig. 3
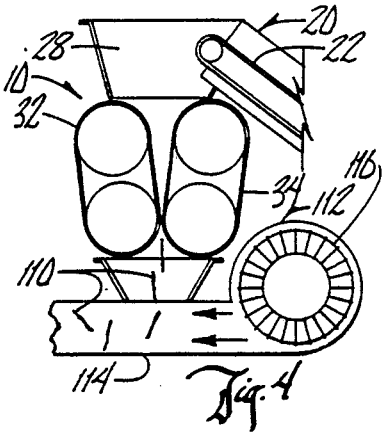
Fig. 4

CAN FLATTENING MACHINE

BACKGROUND OF THE INVENTION

The present invention relates to a can flattening machine, and particularly to a machine for flattening recycled beverage cans.

The normal process for recycling beverage cans is to flatten the cans and then compress the flattened cans into a bale or "biscuit" of rectangular shape. It is therefore desirable to have a quick and efficient means for flattening the cans prior to the time that they are compressed into the bale or "biscuit".

Therefore, a primary object of the present invention is the provision of an improved can flattening machine for flattening disposable metal, cylindrical beverage cans.

A further object of the present invention is the provision of a machine for flattening cans which can do so on a continuous basis so the cans can be continually fed into a baling machine.

A further object of the present invention is the provision of a can flattening machine which can be adjusted to provide varying degrees of pressure to the cans in order to flatten them.

A further object of the present invention is the provision of a can flattening machine which is simple in construction, easy to operate, and efficient in operation.

SUMMARY OF THE INVENTION

The present invention utilizes two continuous belts each of which is trained around a pair of upper and lower roller assemblies. The belt assemblies are oriented in a V-shaped configuration with the point of the V being located in the lower end thereof. The cans are introduced into the V-shaped notch which extends between the two belt assemblies, and as the cans progress downwardly to the bottom of the V, they are compressed by the belts. The cans then exit from the lower end of the V and are dropped into a conveyor which carries them away. The conveyor can be either a belt conveyor or a blower which blows the cans through an air conduit.

One of the lower ends of the belt assemblies is spring mounted so it can spring toward and away from the other belt assembly. This permits large objects or clumps of cans to pass through the device without causing damage to the machine. An adjustment bolt is provided on the lower end of the movable belt assembly so as to permit the adjustment of the distance between the lower ends of the belt assembly, thereby permitting adjustment of the pressure which is applied to the cans.

BRIEF DESCRIPTION OF THE DRAWINGS

FIG. 1 is a perspective view of the can flattening machine of the present invention.

FIG. 2 is a sectional view taken along line 2—2 of FIG. 1.

FIG. 3 is an enlarged detailed perspective view of the lower end of the moveable belt assembly.

FIG. 4 is a partial sectional view of a modified form of the present invention.

DETAILED DESCRIPTION OF THE PREFERRED EMBODIMENT

Referring to the drawings, the numeral 10 generally refers to the can flattening machine of the present invention. Machine 10 comprises a machine frame 12 having four legs 14, a top rectangular frame 16, and a middle rectangular frame 18.

An input conveyor 20 includes a continuous belt 22, an input pan 24, side rails 26, and a hopper 28 having a lower open hopper end 30. The cans to be flattened are deposited in the pan 24 and are carried upwardly by the conveyor belt 22 to the hopper 28 where they are permitted to drop downwardly by gravity.

Located below hopper 28 are a first belt assembly 32 and a second belt assembly 34. First belt assembly 32 comprises a belt 35 which is trained around an upper roll 36 and a lower roll 38. Belt 35 may be made of rubber or other flexible materials as may be desired. Second belt assembly 34 comprises a belt 37 trained around an upper roll 40 and a lower roll 42.

The upper rolls 36, 40 include axles 44, 48, and the two lower rolls 38, 42 include axles 46, 50. The axles 44, 48 of upper rolls 36, 40 are rotatably mounted in bearing blocks 52, 54 respectively which are rigidly attached to the upper rectangular frame 16 in spaced apart relation. Extending downwardly from axle 44 is a spacer frame 56, and extending downwardly from axle 48 is a spacer frame 58. Each of the spacer frames 56, 58 include an elongated slot 60 at their lower ends and a bearing track 62 in which is slidably mounted a bearing 64 for vertical sliding movement. Bearing 64 includes an upwardly extending threaded rod 66 which extends through an ear flange 68 and which is held in vertical adjustable position by means of adjustment nuts 70. Thus, by adjusting nuts 70, it is possible to move bearings 64 upwardly and downwardly to adjust the tension in belts 35, 37.

The lower end of first belt assembly 32 is rigidly held in place by means of a strut 72. The lower end of second belt assembly 34 is movably mounted relative to belt assembly 32 by means of a movable mount 74.

Mount 74 is shown in detail in FIG. 3 and comprises a first rod 76 which is pivotally mounted to intermediate frame 18 by means of a pivot pin 90. A second rod 78 includes a fixed upstanding leg 80 which is rigidly attached to the track 62 at the lower end of spacer frame 58. Second rod 78 also extends through an opening in an ear flange 82 which is rigidly connected to middle frame member 18 as shown in FIG. 3. Adjustment nuts 84 are threaded on to second rod 78 so as to permit threaded adjustment of the rod toward and away from the first rod 76. Extending between first and second rods 76, 78 is a coil spring 86 which is attached to a pair of spring caps 88 at the opposite ends thereof. The spring 86 permits the lower end of the second belt assembly 34 to yieldably move away from the lower end of first belt assembly 32. The threaded nuts 84 permit adjustment of the relative positions between the lower ends of belt assemblies 32, 34 so as to adjust the pressure which they apply to cans passing therebetween.

As can be seen in FIGS. 1 and 2, the belt assemblies 32, 34 are arranged in a V-shaped configuration so as to create a V-shaped slot 92 therebetween, with the lower end of the V-shaped slot being located at the lower ends of the two belt assemblies 32, 34.

A drive motor 94 includes a drive sprocket 96, and the upper rolls 36, 40 of the two belt assemblies 32, 34 each include driven sprockets 98, 100. An idler sprocket 102 helps maintain tension in a drive chain 103.

Below belt assemblies 32, 34 is an outlet hopper 104 for receiving the flattened cans from the lower end of V-shaped notch 92. Hopper 104 permits the flattened cans 110 to drop to a conveyor belt 106. Thus, the unflattened cans 108 are deposited in the hopper 28 and are permitted to fall into the V-shaped notch 92 where they are drawn downwardly between the lower ends of belt assembly 32, 34 and flattened by the pressure between the lower rolls 38, 42. The flattened cans then fall into hopper 104 and drop onto conveyor belt 106 where they are carried away.

Referring to FIG. 4, a modified form of the invention utilizes a large fan or blower 112 which has a rotatable blade 116 for causing a stream of air to be propelled through a fan conduit 114. Thus, the blower 112 and the blade 116 are used to convey the flattened cans 110 instead of the conveyor belt 106 shown in FIG. 2.

The present invention is simple in construction and can be easily operated and repaired. The tension in the two belt assemblies can easily be adjusted by means of the nuts 68, 70, and the pressure which the lower ends of the belt assemblies apply to the cans can be adjusted by utilizing adjustment bolts 84. If a large object inadvertently falls into the V-shaped notch 92, the spring 86 permits the lower end of belt assembly 34 to yieldably move away from the lower end of belt assembly 32, thereby permitting the larger object to pass through the device without damaging the machine. Thus, it can be seen the device accomplishes at least all of its stated objectives.

I claim:

1. A can flattening machine for flattening disposable metal cylindrical beverage cans comprising:

a machine frame having an upper end, and a lower end;

hopper means on said upper end of said frame having an open upper hopper end and an open lower hopper end;

first conveyor means for delivering said beverage cans to said hopper means and for permitting said beverage cans to fall by gravity downwardly through said open lower end of said hopper means;

a can flattening assembly below said hopper means for receiving and flattening said cans after said cans fall from said open lower end of said hopper means;

second conveyor means below said can flattening assembly for carrying said cans from said flattening assembly after being flattened by said flattening assembly;

said flattening assembly comprising a first belt assembly and a second belt assembly, each of which includes an upper roll, a lower roll, and a continuous flattening belt trained around said upper roll and said lower roll, one of said lower rolls being mounted to said frame for movement toward and away from the other said lower rolls; each of said belt assemblies having a spacer frame interconnecting said upper and lower rolls, said spacer frame having a track therein;

bearing means movably mounted within each of said tracks of said spacer frames and being movable within said tracks toward and away from said upper rolls, said lower rolls being rotatably mounted to said bearing means;

first adjustment means interconnecting said bearing means to said frames for permitting selective adjustment of the distance between said upper and lower rolls to adjust the tension in said belts;

a second adjustment means for moving said one lower roll independently of said first adjustment means to selected positions relative to said other lower roll, said second adjustment means including spring means which yieldably holds said one roll against movement away from said other roll, and being capable of yielding in response to a predetermined force to permit said one lower roll to move away from said other lower roll in response to large objects passing therebetween;

said upper rolls of said first and second belt assemblies being spaced apart from one another and said lower rolls of said first and second belt assemblies being closely adjacent one another so as to create a V-shaped slot between said first and second belt assemblies, said slot being located below said open lower end of said hopper means for receiving said cans therefrom whereby said cans will fall into said V-shaped slot, will be flattened between said lower rolls of said first and second belt assemblies, and will fall to said second conveyor means.

2. A can flattening machine according to claim 1 wherein said second conveyor means comprises a continuously moving belt.

3. A can flattening machine according to claim 1 wherein said second conveyor means comprises a blower fan and a blower duct, aid blower duct being positioned below said V-shaped slot for receiving flattened cans therefrom, said blower fan being adapted to direct a stream of air through said blower duct for conveying said cans through said blower duct.

4. A can flattening machine according to claim 1 wherein said flattening belts of said first and second belt assemblies are made of rubber, and said upper and lower rolls are cylindrical steel drums.

5. The can flattening machine of claim 1 wherein said first adjustment means comprises a threaded rod and an ear flange, said threaded rod threaded through said ear flange, one of said ear flange and said threaded rod being connected to said frame, the other of said ear flange and said threaded rod being connected to said bearing means.

6. The can flattening machine of claim 1 wherein said second adjustment means comprises an ear flange, a first rod, a second rod and a spring interconnecting said first and second rods, said first rod pivotally mounted to said frame, said ear flange rigidly connected to said frame, and said second rod extending through said ear flange, said second rod having a fixed upstanding leg attached to said track and a nut threaded on said second rod for permitting the adjustment of the distance between said lower belt assemblies.

* * * * *